US005727614A

United States Patent [19]

Lichy

[11] Patent Number: 5,727,614

[45] Date of Patent: Mar. 17, 1998

[54] OVERHEAD DOOR WITH RELEASABLE BREAKAWAY PANEL

[75] Inventor: Dale M. Lichy, Gibsonia, Pa.

[73] Assignee: Thruways Doorsystems Inc., Pittsburgh, Pa.

[21] Appl. No.: 671,236

[22] Filed: Jun. 27, 1996

[51] Int. Cl.[6] ..... E05D 15/16

[52] U.S. Cl. ..... 160/201; 160/205

[58] Field of Search ..... 160/201, 205, 160/92, 182, 185, 96, 97, 207

[56] References Cited

U.S. PATENT DOCUMENTS

| | | | |
|---|---|---|---|
| 2,286,082 | 6/1942 | Goodman | 160/205 X |
| 2,629,435 | 2/1953 | Dadswell | 160/205 X |
| 4,378,043 | 3/1983 | Sorenson | 160/205 X |
| 4,653,566 | 3/1987 | Miale | 160/201 |
| 4,686,293 | 8/1987 | Hanssen . | |
| 5,535,805 | 7/1996 | Kellog et al. | 160/201 |
| 5,584,333 | 12/1996 | Torchetti et al. | 160/201 |

OTHER PUBLICATIONS

ATMODOOR Environmental Control Doors, Superseal Series 6500 Breakaway Panel (Brochure).

TKO –The Knock Out Dock Door –HPD International, Inc. (Brochure).

*Primary Examiner*—David M. Purol

*Attorney, Agent, or Firm*—Jacobson, Price, Holman & Stern, PLLC

[57] ABSTRACT

A vertically-movable overhead door comprising at least one non-releasable rectangular panel and at least one releasable or breakaway panel pivotable or rollable with respect to said non-releasable panel. The releasable panel may include a pair of rectangular sub-panels having rigid frame portions or may be formed as one rigid frame. Retainer members are connected to one of the rectangular sub-panels to retain the releasable panel with respect to channels positioned adjacent the overhead door. When a sufficient impact force is applied to the releasable panel, the retainer member releases the releasable panel to enable free swinging movement of the panel with respect to the channels.

49 Claims, 10 Drawing Sheets

OVERHEAD DOOR WITH RELEASABLE BREAKAWAY PANEL

BACKGROUND OF THE INVENTION

1. Field of the Invention

The invention relates to an overhead door formed of a plurality of rectangular panels connected to each other and disposed adjacent a door opening whereby the rectangular panels are movable vertically to open and dose the door opening. Channels or tracks having a vertical portion are mounted adjacent side edges of the door opening. The rectangular panels are associated with guide elements such as rollers that are guided within the channels to enable the door to move vertically. The rectangular panels include at least one, and preferably a series of, non-releasable rectangular panels preferably having rollers extending from the side edges of the panels. Attached to the bottommost non-releasable panel is a releasable, breakaway panel, formed preferably of two rectangular sub-panels, each having rigid horizontal top and bottom members and side members to form rigid rectangular frames. Alternatively, the releasable breakaway panel may be a single panel which may be formed by bolting or otherwise securing the two sub-panels together. The rigid horizontal top member is pivotal or rotatable with respect to the bottommost non-releasable panel for universal movement in all planes. The two sub-panels are rotatable and shiftable with respect to each other against the return force of a spring mechanism. The bottom sub-panel includes a releasable retainer mechanism connected to its rectangular frame to retain the panel in position with respect to the channels during normal or routine movements of the door and for releasing the panel to enable freely swinging movement of releasable panel with respect to the channels when a predetermined impact force is applied to the releasable panel.

2. Description of Related Art

Overhead doors formed from a plurality of rectangular panels hingedly connected to each other and including rollers which are guided within guide channels or tracks positioned adjacent the side edges of the door opening are well known in the art. Such overhead doors move vertically with the rollers captured within the channels or tracks. The channels or tracks may curve from a vertical into a horizontal position in a relatively short distance above the door opening, an arrangement known as a standard lift overhead door system. In another arrangement, called a high lift system, the track also curves but over a greater distance above the door opening and ultimately into a horizontal position. Another overhead door arrangement, known as a full vertical lift system, is where the door panels move straight upwards, or at a gentle angle away from the door.

One of the problems with the known overhead door arrangements is that often the horizontal panels are not moved completely out of the door opening perimeter and the lower or bottommost panel extends just below the horizontal door frame which makes it susceptible to being struck by vehicles or objects, such as forklifts, automobiles, trucks, etc. Thus a need has arisen to design an overhead door system that minimizes the damage to at least the bottommost rectangular panels when struck by motor vehicles or other tall structures that pass through the door opening.

An alleged impact resistant overhead door is disclosed in U.S. Pat. No. 4,676,293 wherein the bottommost panel includes flexible and resilient components so that the panel bends when receiving an impact force. The bending occurs about a vertical axis, or an axis perpendicular to the bottom edge, and results in inward displacement of the side frames of the door panel which receive the track mounted roller pins. Such inward displacement results in disengagement of the rollers thus enabling the bottommost panel to swing into and out of the door opening. The disadvantage of such an overhead door is that the bottom panel is relatively flexible and deformable and thus not as solid and structurally secure as the remaining panels.

Another overhead door having a breakaway panel is understood to be manufactured by SuperSeal, a Canadian company, and sold in the United States. As described in a SuperSeal brochure (undated, but available since at least March 1996) and product literature, the SuperSeal door includes a breakaway panel inset portion that is within a larger rectangular panel frame of the overhead door. The panel inset portion is deformable or flexible in part so as to bend or deform and then swing with respect to the door opening. The swingable panel portion is not itself hingedly connected to the bottommost rectangular adjacent panel. That is, the overall frame of the bottom rectangular panel is not capable of breaking away but only the inset panel portion. The SuperSeal door has disadvantages similar to as that of U.S. Pat. No. 4,676,293. Namely, it requires a flexing or deformation of the swingable inset panel portion to enable that portion to break away from the remaining frame.

Another door arrangement known as The Knock Out Dock Door manufactured by HPD International, Inc. includes a plurality of rigid panels having spring loaded plungers adjacent side edges that engage with specially designed tracks or channels that form a cam or ramp to cause the plungers to withdraw when a panel is struck. No rollers are associated with thee panels. One disadvantage of this door is the requirement of specially designed, and expensive, tracks instead of standard channels or tracks that are typically used in standard garage door systems within the overhead door industry, and the inability of the system to be used with side rollers. This door system cannot be readily retrofitted to existing standard door tracks.

SUMMARY OF THE INVENTION

The present invention relates to an overhead door arrangement formed from at least one, and preferably from a plurality of, non-releasable rectangular panels and at least one releasable breakaway panel defining the lowermost portion of the door. The non-releasable panel or panels include guide elements, such as rollers that are retained in tracks or channels disposed on opposite sides and adjacent to the door opening. The tracks are vertical adjacent the door opening and curve backward or inward into the building above the door opening (for standard lift and high lift door arrangements) or may extend fully vertical in high-ceilinged applications (full vertical lift door arrangements). The door is movable between a closed position and an open position whereby the guide elements or rollers are guided within the channels during the upward and downward movement. In the open position, portions of the releasable panel may still He within the overall perimeter of the door opening, adjacent the top edge of the door. The releasable or breakaway panel, preferably formed from two rectangular sub-panels, includes a horizontal top member that is pivotally arranged with respect to the bottom most non-releasable panel and capable of free swinging movement into and away from the plane of the door opening, and angular or pivotable movement with respect to the plane of the door opening, when an impact force of sufficient magnitude to release the panel is applied, in either direction, on the panel. One of the embodiments of the releasable panel includes a rigid bottom horizontal member and preferably two side structures each of which includes at least one side member that is fixedly connected with the bottom horizontal member. Associated at a bottommost corner where the rigid side member joins with the bottom horizontal member, is a releasable retaining mechanism to retain the releasable panel in its aligned position with respect to the non-releasable panels during the normal upward and downward movement of the panels. Upon receipt of an impact force, the releasable retaining mechanism enables the releasable panel to disengage and swing freely in directions into and away from the door opening without any bending or yielding about any axis perpendicular to the lower horizontal member. That is, there is no deformation of the releasable panel in a direction along the impact force that would cause the side member of the releasable panel to move inwardly, away from the roller. Thus, the rectangular panel maintains its structural rigidity during the release or breakaway operation.

Thus, it is an object of the present invention to provide an overhead door having a releasable rectangular panel formed preferably from two rectangular sub-panels, that is non-yieldable or bendable at its top and bottom horizontal members. The rigid top member is preferably hingedly connected to, or rotatably positioned adjacent, the bottommost nonreleasable panel for freely swinging movement into and away from the plane of the door opening. The bottom horizontal member, along with preferably a rigid side beam, forms a rigid structure for affixing a retainer member that maintains the panel in its normal position with respect to the vertical track or channels during up and down movement. The retainer member permits release or disengagement of the panel so that the panel may disengage and move freely when the panel receives an impact force. The bottom horizontal member is incapable of flexing or bending about an axis substantially perpendicular to the bottom horizontal member in the direction of an impact force. Thus the bottom corners and/or side members or edges do not move horizontally away from the track or channel when an impact force is received. Rather, the breaking away of the retainer member results from force vector components in a direction perpendicular to the rigid bottom member. There is no, or negligible, flexure or deformation of the bottom sub-panel along any axis perpendicular to the top and bottom horizontal members. Thus, the rigidity and security of the breakaway or releasable panel is maintained.

It is further an object of the present invention to provide a releasable or breakaway panel having rigid top and bottom horizontal members and side structures each of which includes at least one rigid side beam whereby the rigid top member is hingedly connected to the bottommost non-releasable panel for free swinging and pivotable movement in directions to and away from the plane of the door opening and at angular positions with respect thereto.

Still further, it is an object of the present invention to provide a releasable panel formed from two rectangular sub-panels each having a rigid, non-yieldable or bendable frame or having an overall rigid rectangular shape. The two sub-panels are connected to each other by spring members which enable each sub-panel to flex or rotate about horizontal and vertical axes with respect to each other and thus to be movable away from coplanarity with each other, and to be skewed at acute angles with respect to each other, but always moving against the return force of a spring bias which tends to urge each of the sub-panels back into engagement and alignment with each other. Each of the rectangular sub-panels may be rigid around their peripheral regions or rigid throughout their rectangular shape. Thus, there is no flexure, bending, or deformation of the rigid sub-panels and each maintains its rectangular planar configuration upon receipt of an impact force. Although the two rectangular sub-panels may pivot or flex along horizontal axes with respect to each other, and may pivot or flex about vertical axes with respect to each other, or in planes skewed with respect to each other, the panels themselves maintain their rigid rectangular, planar configuration during all such movements.

DESCRIPTION OF THE PREFERRED EMBODIMENTS

Figures 1, 2:
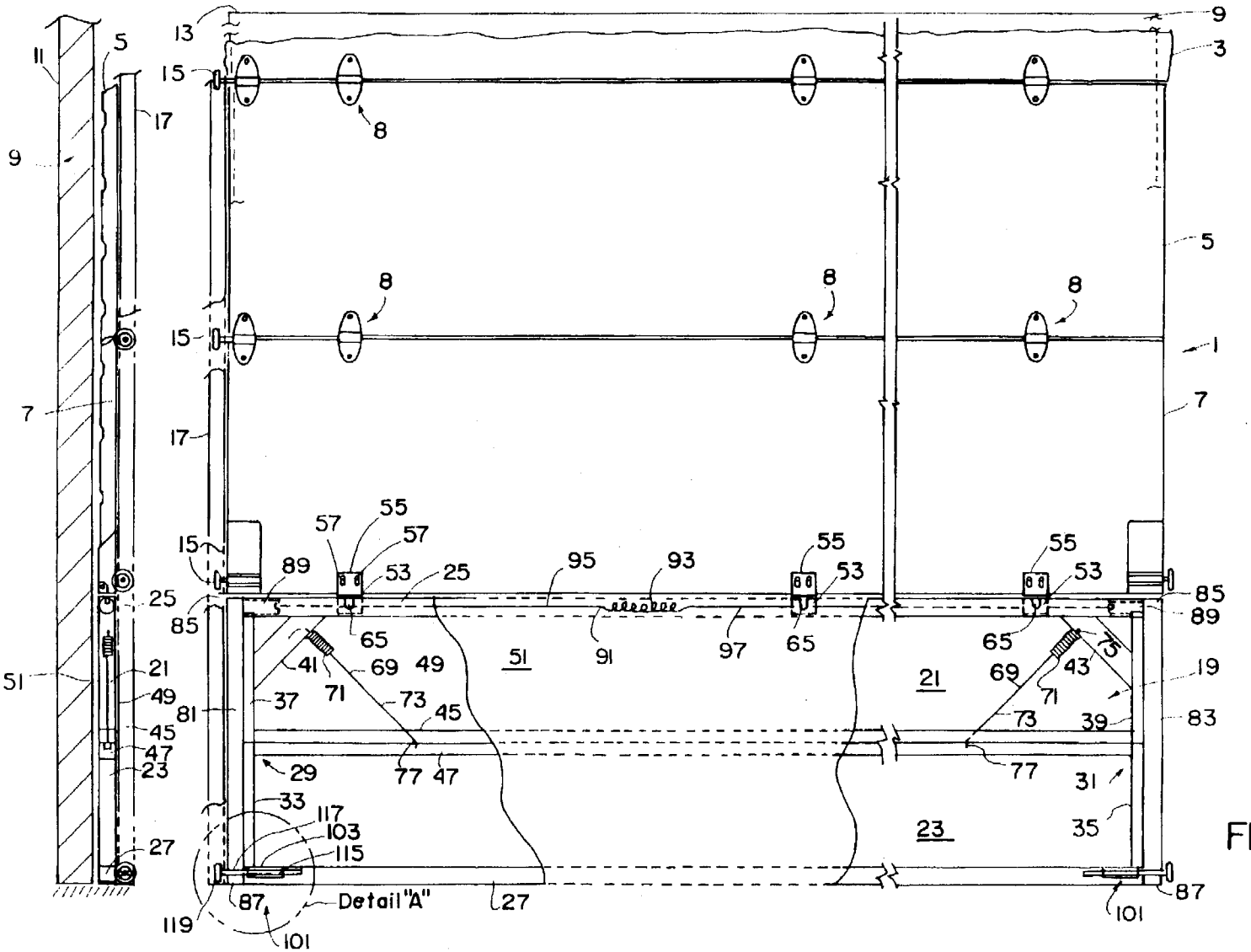
FIG. 1 is a partial cutaway front view of the overhead door with releasable panel of the high lift or full vertical lift type viewed from inside a building structure and depicting schematically one of the two side tracks or channels and the door opening.
FIG. 2 is a partial cutaway side view of FIG. 1 from the left side of FIG. 1.
Figure 20:
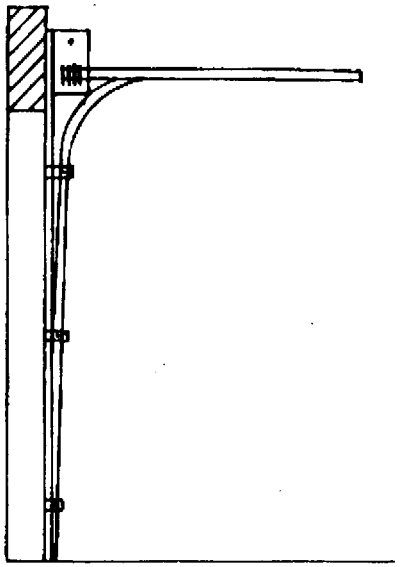
FIG. 20 is a side view of the track or channel for a standard lift door.
Figure 19:
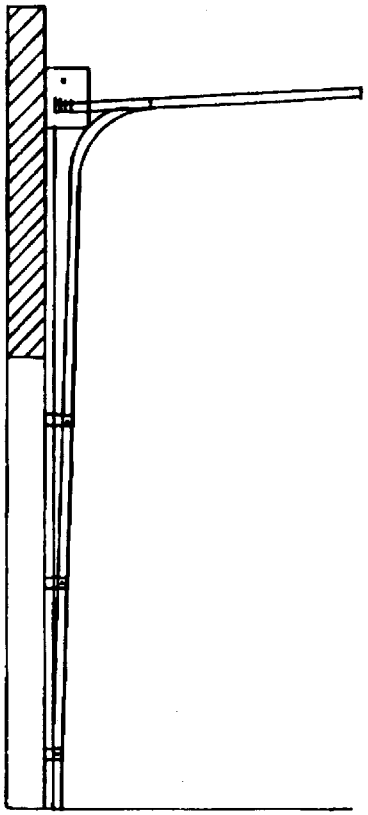
FIG. 19 is a side view of the track or channel for a high lift door.
Figure 18:
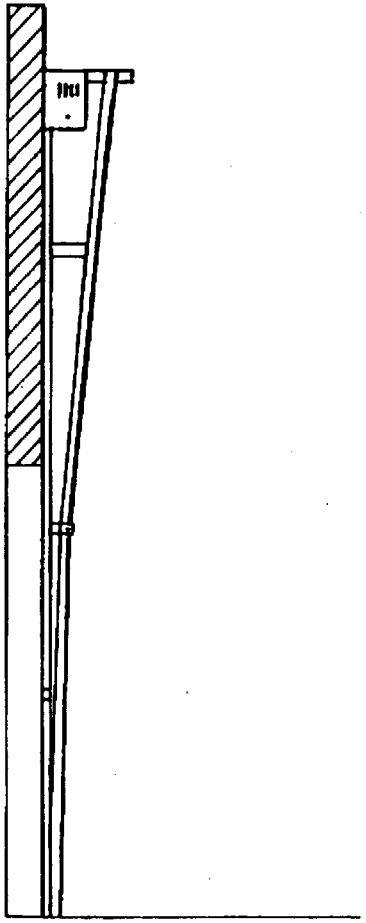
FIG. 18 is a side view of the track or channel for a full vertical lift door.

The present invention relates to an overhead door 1 formed from at least one non-releasable rectangular panel and preferably a plurality of non-releasable rectangular panels 3, 5, 7, each of which are hingedly connected to each other, through hinges 8, in a manner known in the art. The term "non-releasable", as used herein, means a panel that is designed to be maintained with respect to the channels or tracks and not capable of breaking away upon receipt of an impact force; the panels may, of course, be removable for repair or disassembly purposes. The panels are situated adjacent a door opening 9 having sidewalls 11 (only one of which is shown) and a top wall 13. The rectangular non-releasable panels have rollers 15 associated therewith which are secured to the edges of each rectangular panel at the rotational or pivotal interconnection between adjacent panels, which rollers are captured within tracks or channels 17 having a vertically disposed section, only one of which is shown in FIG. 1. It is understood that the opposite side of the overhead door (i.e. the fight side of the door of FIG. 1) also includes rollers that are captured within a channel similar in construction to channel 17. As is well known, the side-to-side width of the non-releasable panels may be greater than the side-to-side width of the door opening or may be of substantially the same width as the door opening. The vertical channels or tracks 17 are mounted on walls adjacent the door opening, or independently supported adjacent the door opening, such that the overall combined side-to-side width of the two channels 17 and the panels 3, 5, 7 are greater than the side-to-side width of the door opening. As is known in the art, the configuration or curvature of the channels 17 may differ depending upon the specific type of door arrangement. Overhead doors known as high lift doors or full vertical lift doors are of the type shown in FIG. 1. A full vertical lift door includes substantially vertical channels that extend well above the door opening, for those facilities having high ceilings, such that the overhead door moves in a substantially vertical track, without any substantial curvature away from the door opening, so that the overhead door moves substantially vertically from a dosed position that completely covers the door opening to an open position where the various panels remain positioned substantially vertically above the door opening. The track or channel for a full vertical lift door is shown in FIG. 18. In high lift doors, the two tracks on either side of the door opening curve away from the door opening, and inward into the building, so that ultimately at least one of the articulated panels is in a substantially horizontal position but at substantial height above the door opening. That is, the track curvature from its vertical orientation is substantially above the door opening, as shown in FIG. 19. Another type of overhead door is what is known as a standard lift door whereby the vertical channels on either side of the door opening curve backward and away from the door opening into a horizontal position at a relatively small radius of curvature so that the change between a vertical orientation of the track and horizontal orientation of the track occurs over a one to two foot distance and adjacent the top of the door opening, as shown in FIG. 20.

As shown in FIG. 1, only two complete non-releasable rectangular panels 5, 7 are shown and a partial panel is shown as numeral 3. It should be understood to those skilled in the art that the number of non-releasable rectangular panels may vary depending upon the size of the door opening.

Pivotally or rotatably connected to the bottommost non-releasable panel 7 is a releasable or breakaway rectangular panel 19 formed of two rectangular sub-panels 21, 23. In certain arrangements, a plurality of releasable panels may be utilized, particularly for full vertical lift doors. The releasable panel 19 includes a rigid top horizontal member 25, a rigid bottom horizontal member 27, and a pair of side structures 29, 31 each of which include at least one rigid side member 33, 35 on opposite edges of the rectangular panel. The top-most rectangular sub-panel 21 is defined by the rigid top horizontal member 25, rigid side members 37, 39, with rigid angular braces 41, 43 at substantially 45° angles between the top and side members. The top-most sub-panel 21 is further defined by a rigid horizontal intermediate member 45. The frame defined by the members 25, 37, 39 and 45 may be of steel or aluminum beams welded or otherwise secured to each other to form a rigid rectangular structure or may be of structurally rigid fiberglass or plastics material. The beams 37, 39, 45 may be hollow, four-sided square beams, or three-sided channels, or of any shape or material to produce a solid, essentially inflexible frame. The top member 25 is tubular as will be described below.

Similarly, bottom sub-panel 23 is defined by rigid side members 33, 35, rigid bottom horizontal member 27, and a rigid horizontal intermediate member 47 each of which are welded or secured together. As is the case with the top sub-panel 21, the bottom sub-panel structure may incorporate many shapes or materials in attempting to maintain an essentially inflexible frame.

The panel 21 includes sheeting on front and back faces 49, 51. The sheeting may be sheet steel, aluminum, or similar inflexible materials, or may be a flexible heavy-duty fabric, such as PVC. In addition, one face could be sheet steel or other inflexible material and the opposite face could be of a flexible or deformable fabric material. The bottom panel 23 is formed with similar facings. The space defined by the front and back faces of sheeting and the rectangular frame of each of the sub-panels 21, 23 may be filled with a foam or urethane material.

The top horizontal member 25 is a rigid cylindrical hollow tube that swivels about swivel sleeves 53 in a manner to be described. The swiveling of the tube 25 enables the releasable panel 19 to swivel into and away from the plane of the door opening in a manner similar to that as generally shown in FIG. 10 with respect to the FIG. 7 embodiment, as will be described.

Figure 6:
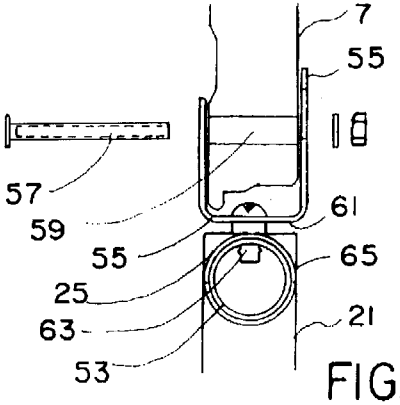
FIG. 6 is a partial exploded cross-sectional view of the hinged, swingable connection between the top horizontal member and the bottommost non-releasable panel.

The rectangular panel 19 is rotatably or pivotally connected to the bottom most rectangular panel 7. The bottom-most rectangular panel 7 includes a plurality of U-shaped brackets 55, as best shown in FIG. 6. Alternatively, a single elongated U-shaped bracket that extends along the entire side-to-side length of the panel 7 may be provided. The brackets 55 are secured to the front and back faces of the non-releasable panel 7 through a pair of bolts 57 that extend through the openings in the U-shaped bracket 55 and through a hollow cylindrical filler tube 59 to enable tightening of the bolt 57 (and associated nut) without deforming or damaging the panel 7. At the bottom web portion 61 of each bracket, lies an opening through which a swivel bolt 63 extends therethrough. The swivel bolt 63 has a bolt head that mates with the underside of the web 61 and the bolt shank 63 extends through an opening or slot 65 in the top member 25 that extends circumferentially about the top member swivel tube 25 over an angle preferably just greater than 180°. The opening thus forms a circumferential slot through which the bolt shaft 63 extends. The bolt shaft 63 is rotatably secured to swivel sleeve 53 and the swivel sleeve may rotate about the shaft axis. The swivel sleeve 53 is a tubular annular member preferably formed from steel that enables the swivel tube to be easily slidable about the sleeve. Thus, it should be apparent that the rigid top horizontal member, comprising the swivel tube 25, is freely rotatable about the swivel sleeve 53 as the first sub-panel 21 is able to move through angles substantially 90° on each side of vertical. In addition, the panel 21 may be skewed or angled with respect to the panel 7 about the axis of the bolt 53.

Preferably, four bracket assemblies 55 are used to interconnect the bottommost panel 7 with the releasable panel 19. However, depending upon the overall width, more or less bracket members may be utilized. Moreover, for ease of manufacture, a single elongated bracket extending across the entire end-to-end length of the non-releasable panel may be utilized instead of separate brackets.

The upper panel 21 is connected to the lower panel 23 through a pair of springs 69. The springs include a coiled section 71 and an inflexible or non-stretchable section 73. The coil portion 71 may be a separate coil spring with a circular hook portion at the end for connection with the non-stretchable member 73. The coil springs 71 includes a hook or circular portion 75 that is inserted within a hole or opening within the angled braces 41, 43. The opposite end of the spring 77 is inserted through openings in the bottom horizontal intermediate member 45, and into openings within the top horizontal intermediate number 47 to be retained to the member 47 in any conventional manner. This enables the bottom panel 23 to move with respect to upper panel 21 against the resistance of the force of the spring. An example of this movement is shown in FIG. 10 with respect to the embodiment of FIG. 7 which is otherwise identical. It should also be noted that the bottom panel is not only capable of movement about a horizontal axis with respect to the panel 21, as generally shown in FIG. 10, but the two panels may move angularly or rotatably along axes perpendicular to the horizontal members 45, 47 so as to be skewed or angled with respect to each other. Such an angular movement may occur depending upon how the panel is struck by a vehicle or structure passing through the door opening. However, all such movement, regardless of in which plane, is against the resistance or bias of the spring 69 which spring tends to bias the two panels back into alignment and into a generally coplanar position.

As shown in FIG. 1, the springs 69 are shown angled at substantially 45° with respect to the intermediate horizontal member 45. However, this is not critical and the spring 69 may extend in a direction substantially parallel to the side beams 37, 39 and through the intermediate member 45 to be affixed to the member 47. In addition, more than two springs may be utilized. Additional springs may extend from the angular braces 41, 43, or even from the top horizontal member 25.

Adjacent each of the side structures 29, 31 are side frame members 81, 83. In the high lift and full vertical lift applications, the side frame members 81, 83 are essentially filler tubes for filling the space between the side structures 29, 31 and the channels 17. Each side frame member 29, 31 a rigid, hollow, square tube formed of steel and is continuous along its entire length from its top end portion 85 to its bottom portion 87. Extending from each top end portion 85, and substantially perpendicular thereto, is a tubular cylindrical swivel tube 89, formed from steel, which is dimensioned similar in overall cross-sectional shape to the swivel tubes 53. Swivel tubes 89 are affixed, such as by welding, and rigid with, the side frame members 81, 83. The swivel tubes 89 extend into the hollow tubular top horizontal member 25 at each of the ends thereof. Thus, the top member 25 is freely swingable and rotatable about the tubes 89 thus enabling the upper panel 21 to be freely and swingably movable with respect to the side frame members 81. The side frame members remain positioned adjacent the tube 25 by means of a spring biasing arrangement 91 which includes a coil spring member 93 and two non-yieldable wires 95, 97 whose ends are retained within the tubular swivel tubes 89. Thus, the swivel tubes 89 are biased in directions toward each other to retain the side frame members 81 in position adjacent to the releasable panel 19.

With respect to the high lift or full vertical lift arrangements the bottom portion 87 of each of the side frame members 81, 83 has no permanent attachment to the rigid side beams 33, 35. Indeed, the attachment may be a weak attachment such as tape or a velcro-type coupling (not shown) that may be easily releasable at impact forces far less than is required to release the bottom panel 23, in a manner to be described.

Figure 3:
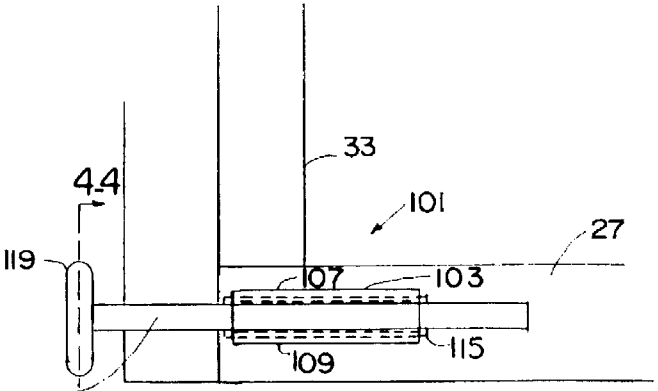
FIG. 3 is a dose-up view of the left corner of FIG. 1, identified as "Detail A".
Figure 4:
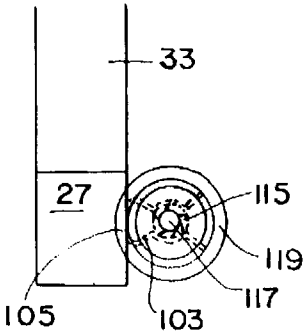
FIG. 4 is a partial sideview of FIG. 3 viewed along section line 4—4 of FIG. 3.
Figure 5:
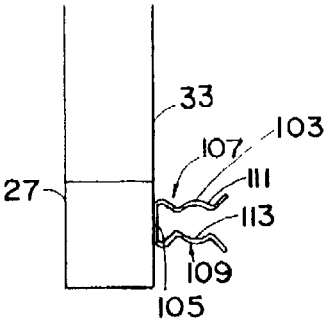
FIG. 5 is a detail of the retaining clip of the present invention.

Positioned adjacent to each lower corner of the rectangular panel 19, are retainer members 101. The retainer members are fixed to a rigid portion of the rectangular panel and, in the embodiment of FIG. 1, the retainer members 101 are disposed on the bottom horizontal member 27. Details of the structure of the retainer member are shown in FIGS. 3–5.

The retainer member 101 includes an elongated retaining clip 103. As shown in FIG. 3, the clip 103 is disposed so that its longitudinal axis is substantially parallel with the horizontal bottom member 27. The length of the retaining clip preferably may be between one and six inches. The retaining clip 103 includes a base web 105 which is fastened to the bottom member 27 by standard fastening arrangements, including welding. The retaining clip 103 includes a pair of retaining clip arms 107, 109 in facing relationship to each other and flexible, biased, and made of a material which has memory so that when pressed apart in opposite directions, they spring back into the position shown in FIG. 5. Intermediate along the clip arms 107, 109 is a profile portion 111, 113 that is arcuate to accommodate a cylindrical retaining tube 115, also formed of rigid material such as steel. The length of the retaining tube 115 is approximately the length of the retaining clip 103 or maybe slightly longer as is shown in FIG. 3. The retaining tube 115 has an inner diameter sized to receive a roller shaft 117 therethrough. The roller shaft 117 is journaled to a roller 119 through a well-known ball bearing mechanism, not shown. The roller shaft 117 is slightly smaller in diameter so that there is some limited play between the roller shaft 117 and the retaining tube 115. The roller 119 is captured within the side track or channel 17 and is rollable within the track 17 as the door is moved from its closed position as shown in FIG. 1 to an upward position in the normal operation of the door.

Figure 10B:
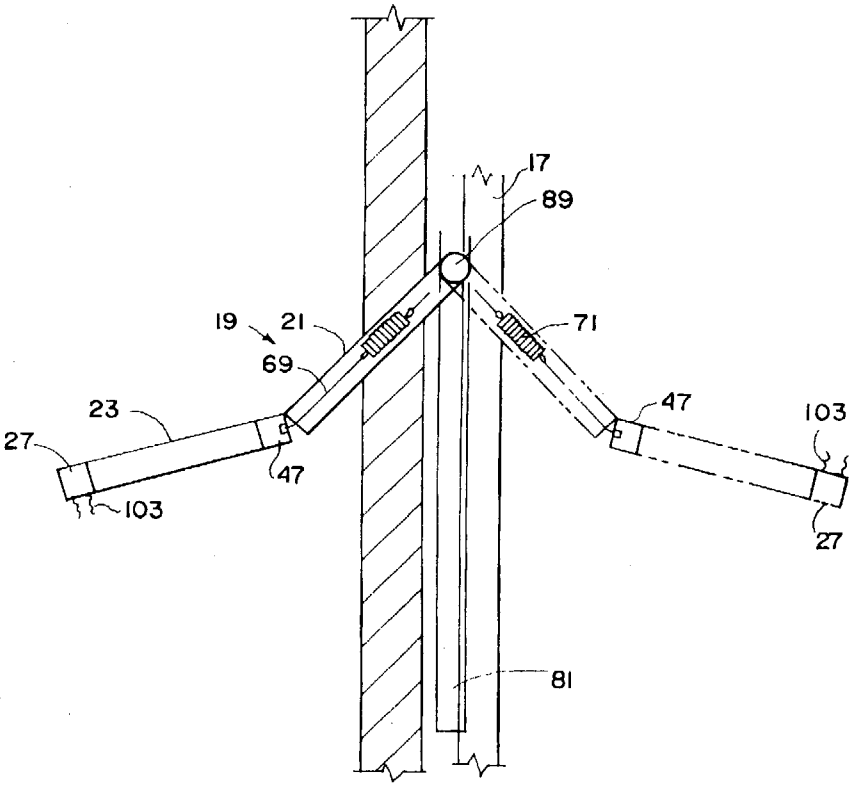
FIG. 10B is a cross-sectional side view of the panel of FIG. 1 depicting free swinging movement in opposite directions into and away from the plane of the door opening.

The retainer member 101 is designed so that when a predetermined impact force is provided to the releasable panel typically imposed upon the lower horizontal member 27 when the overhead door is in an upward position such that the releasable panel lies below the top of the door opening, the impact force will result in the bottom panel 23 to breakaway or release to enable freely swingable movement of the releasable panel 19 with respect to the channels 17. If, for example, an impact force is applied to the bottom sub-panel 23 of the releasable panel 19, the bottom horizontal member 27, which is rigid, will move into and through the plane of the door opening such that the retaining clip 103 snaps away from the cylindrical retaining tube 115. During this breakaway movement, the lower panel 23 typically will also swing with respect to the upper panel 21. An example of such movement is shown in FIG. 10B. Note that the release may occur in either direction. That is, an impact force applied to the bottom of the releasable panel 19 from outside the facility, i.e. from a direction out of the plane of FIG. 1 facing the reader, will result in a breakaway of the retaining clip 103 with respect to the cylindrical tube 115.

During the release, the side frame members 81, 83 are not intended to move with the releasable panel 19. Rather, the releasable panel 19 rotates or pivots freely with respect to the side frame members about the tubular members 89. Note further that the roller 119, and roller shaft 117 do not break away with the releasable panel 19.

The releasing of the releasable breakaway panel 19 usually occurs when the overhead door is rolled into an upward position whereby only the releasable panel portion of the door panels are within the confines of the door perimeter. That is, typically the overhead door is not in a fix fly upward position or at least in a position where portions of the releasable panel are still within the overall confines or perimeter of the door opening. Thus, when a vehicle of a large height passes through the door opening, the upper portion of the vehicle has a tendency to strike the bottom portion of the overhead door, thus causing release as described above.

It should also be noted that it is essential that at least the bottom horizontal member 27 be rigid and incapable of bending, flexure, or deformation (other than, perhaps, some negligible bending, etc.) along an axis perpendicular to the member 27. The rectangular frame of sub-panel 23 must remain substantially rigid so that the force applied to the frame is perpendicular to the bottom member 27 to secure a release of the retaining clip 103 from the cylindrical tube 115. The side structures 29, 31 do not move, during the impact, in an inward direction away from the track or channel 17. This would detract from effective operation of the invention since the impact force should always be directed perpendicular to the bottom beam 27 to enable release.

Figures 7, 8:
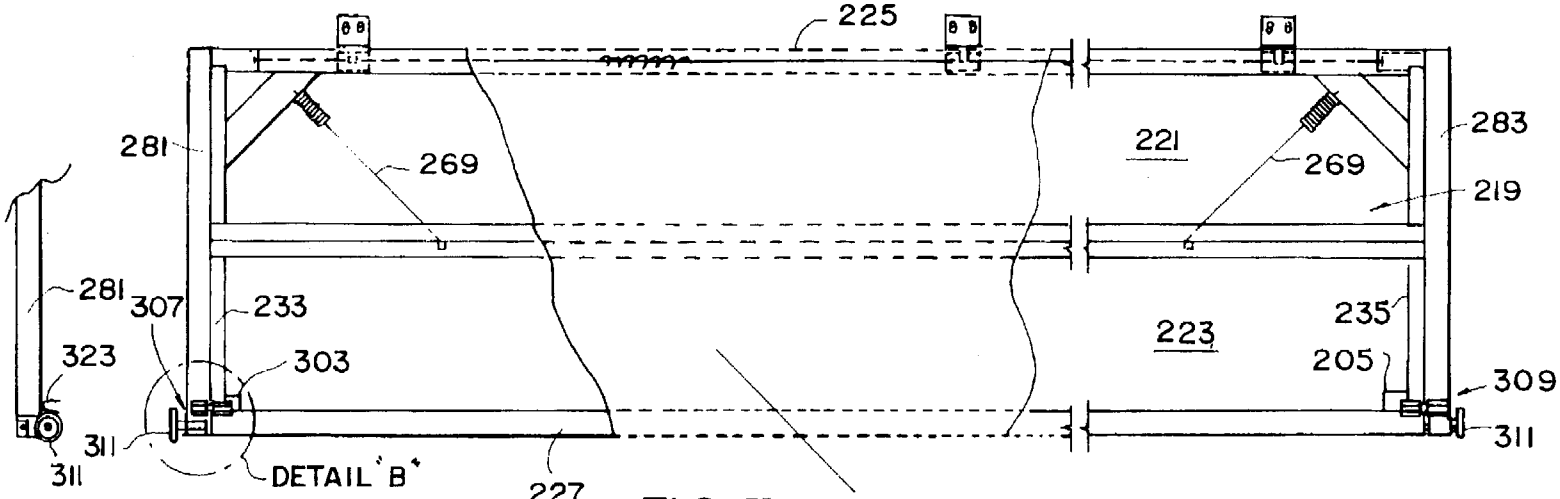
FIG. 7 is a partial cutaway front view of a releasable panel for an overhead door of the standard lift type as viewed from inside a building structure.
FIG. 8 is a partial side view of the bottom left side corner of FIG. 7.

Another similar door arrangement is shown in FIGS. 7–9 and 10A. This door arrangement is typically employed in a standard lift assembly in which the vertical tracks or channels on either side of the overhead door curve to a horizontal position just above the door opening, in a manner well known in the art. The non-releasable panels and the tracks or channels on either side of the overhead door are of the same construction as in the embodiment of FIG. 1 and are not shown in FIG. 7. FIG. 7 shows only the releasable panel 219 without the tracks and without the remaining non-releasable panels. Moreover, for convenience, the numerals for the embodiments of FIGS. 7–9 and 10A parallel the numerals for the embodiment of FIGS. 1–6 and 10B except that they are prefixed by the series "200". Thus, rectangular releasable panel 219 corresponds to panel 19 of FIG. 1, the horizontal top member of FIG. 7 is identified as numeral 225 instead of 25, etc. The differences will be prefixed with the "300" numeral.

Turning to FIG. 7, the rectangular panel 219 includes a first sub-panel 221 and a second sub-panel 223, having a rigid perimeter as in the FIG. 1 embodiment. Indeed, the upper panel 221 is identical to panel 21 of FIG. 1. The bottom panel 223 is identical to panel 23 except that the bottom corner includes steel reinforcing portions 303, 305 which are welded to closely fit and abut the rigid side beams 233, 235 where they join with the bottom horizontal member 227. As will be apparent from the discussion below, this provides a greater planar face for mounting the retainer members 307, 309.

Figure 9:
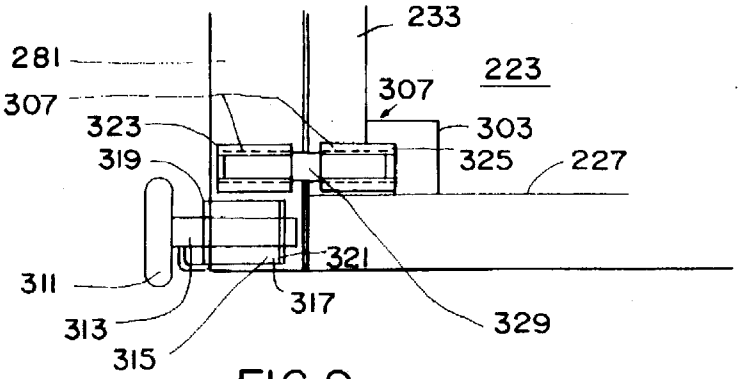
FIG. 9 is a close-up view of the left corner of FIG. 7, identified as Detail "B".

In the embodiment of FIG. 7, as best shown in FIG. 9, the side frame members 281, 283 are themselves guided within the vertical tracks or channels 17 through rollers 311 which are captured within the track or channel 17 in the same manner as the FIG. 1 embodiment. The rollers 311 are journaled, via ball bearings, to a roller shaft 313 which extends through a U-shaped bracket 315 having a web 317 welded or otherwise fastened to the sideframe member 281, which bracket 315 includes a pair of parallel plates 319, 321 having holes or openings therein through which the roller shaft 313 extends. The roller shaft 313 may be permanently welded to the plates 319, 321 and does not move with respect thereto. Rather, the roller 311 moves with respect to the shaft 313.

The retainer member 307 includes a pair of retaining clips 323, 325 each having the same configuration as the retainer clip as best shown in FIG. 5 but having a length that is substantially shorter. That is, the length of each retainer clip 323, 325, in a direction along its major axis and parallel to the bottom horizontal member 227 may be one to three inches. Retainer clip 323 has its back web welded or otherwise fastened by bolting through the back web to the sideframe member 281 just above the position of the bracket 315. Positioned co-linearly adjacent thereto is retainer clip 325 which has a back web welded or bolted to the face of the rigid side beam 233 and the insert 303. Each of the retaining clips 323, 325 are profiled to receive a cylindrical retaining shaft 329 oriented substantially parallel to the top and bottom horizontal members of the releasable panel. The retaining shaft 329 is preferably a solid steel cylindrical shaft having substantially the same diameter as the hollow cylindrical tube 115 in the embodiment of FIGS. 1–6. The shaft 329 is capable of being ejected by each of the retaining clips 323, 325 when an impact force is applied to the releasable panel in the region of the bottom horizontal member 227.

Figure 10A:
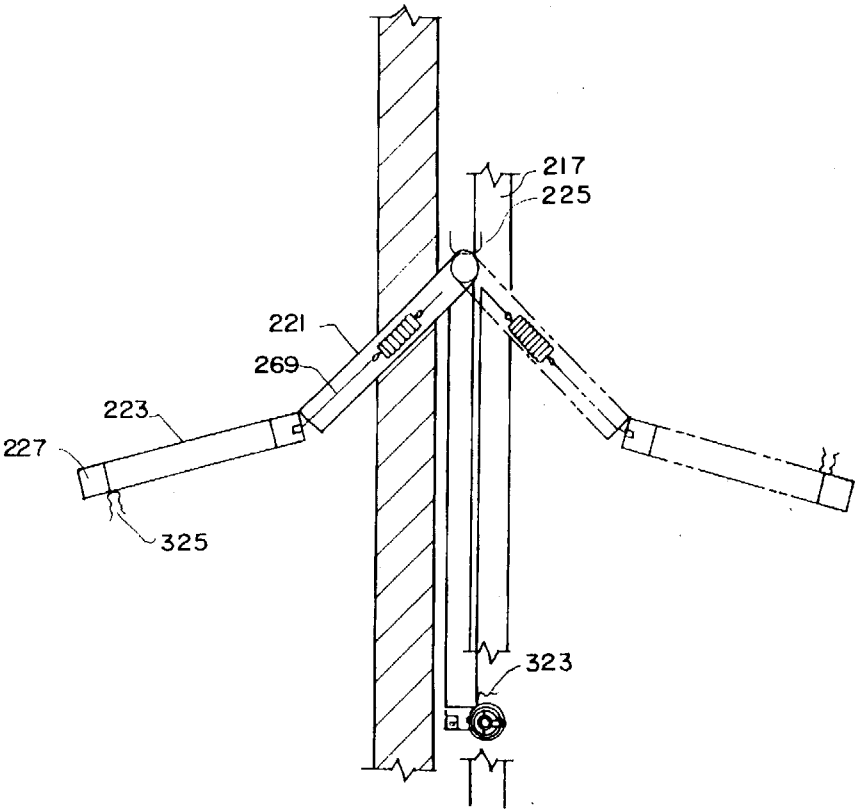
FIG. 10A is a cross-sectional side view of the panel of FIG. 7 depicting free swinging movement in opposite directions into and away from the plane of the door opening.

When the overhead door is in an upward position such that a portion of the door is below the door opening, and in a position to be struck by a vehicle or structure moving through the door opening, in either direction, a sufficient impact force upon the releasable panel, particularly at the bottom portion thereof on the bottom sub-panel 223 and particularly the bottom horizontal member 227, results in a movement of the rigid portions of the bottom panel formed by the side beam 233, bottom beam 227 and insert 303 which carries the retaining clip 325 therewith to thus disengage or release from the tube 329. The tube 329 thus snaps out with respect to the retaining clip 325, as well as with retaining dip 323 and falls downward enabling the panel to swing freely in directions into and away from the plane of the door opening. This swinging movement is depicted in FIG. 10A. The upper sub-panel 221 and bottom sub-panel 223 may be separated and angularly displaced or skewed in various directions with respect to each other against the bias of the springs 269, in a manner as previously described.

In each of the embodiments described above, the overhead door moves vertically between an open and closed position by an electric motor, chain hoist or manually pushed and pulled, and counter-balanced via a cable mechanism, which arrangements are well-known in the art. In the embodiment of FIGS. 1–6, the cable would be connected to the bottommost non-releasable panel 7. In the embodiment of FIGS. 7–9 and 10A, the cable would be connected to the sideframe members, 281, 283, toward the bottom thereof.

Upon release or disengagement of the releasable panel 19, 219, re-assembly is easily effected. Because of the solidity of the rigid rectangular sub-panels, little permanent damage thereto exists. The panels can be easily realigned and the retainer members reassembled without replacement or disassembly of the overhead door.

In another embodiment of the present invention, not specifically shown in the drawings, the releasable panel may be a single rectangular panel instead of two sub-panels. That is, the side structures 29, 31 may not be bifurcated but instead formed from two straight rigid side beams. Thus, the releasable panel will include a top horizontal rigid member coupled with the adjacent non-releasable panel in the same manner as FIG. 1, and a horizontal rigid bottom member having retainer members of either the FIG. 1 or FIG. 7 embodiments, and a pair of straight, rigid, non-articulated side beams. The side frame members will be the same as in FIG. 1 or FIG. 7. In this embodiment, there may be no need for any horizontal intermediate member, although such could be included for further structural rigidity. In this embodiment, the releasable panels are capable of moving into and away from the plane of the door opening but without any flexure along an intermediate horizontal axis.

Figure 11:
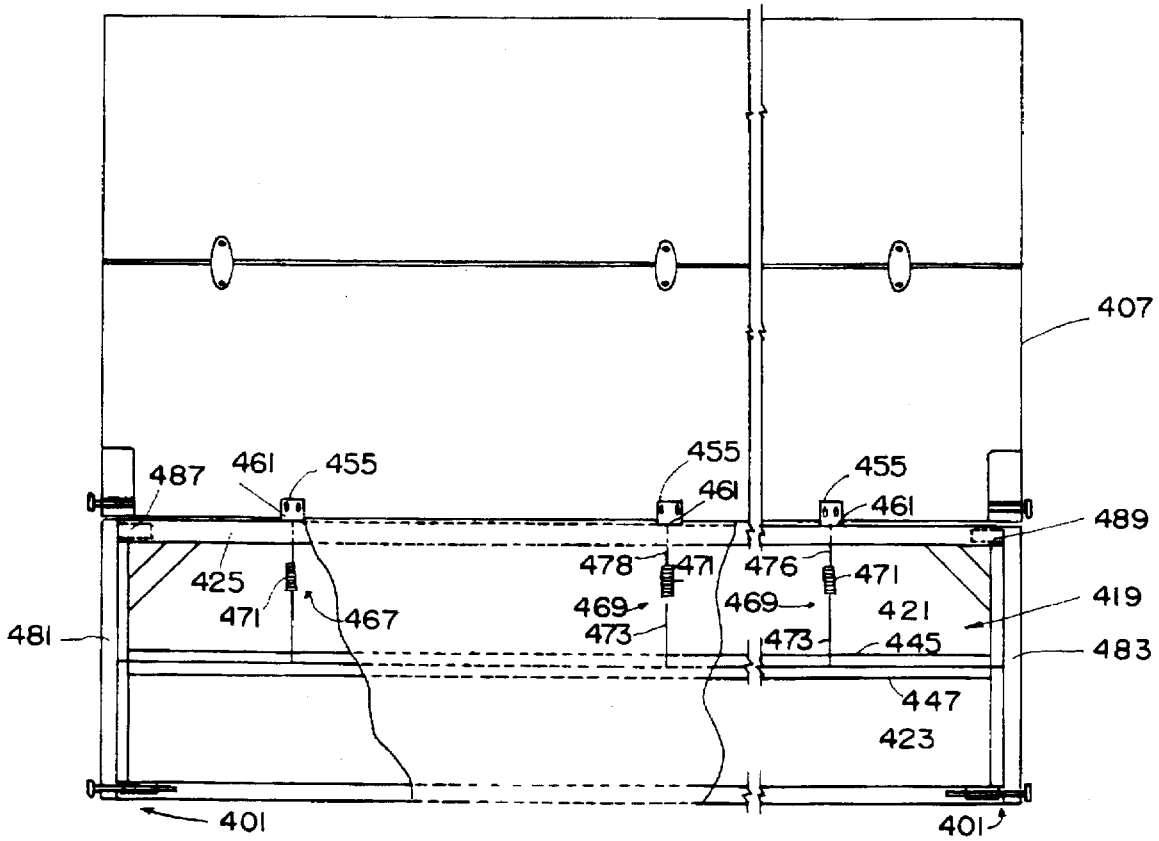
FIG. 11 is a partial cut-away front view of another embodiment of the overhead door as viewed from inside a building structure without the side tracks or channels.
Figure 12:
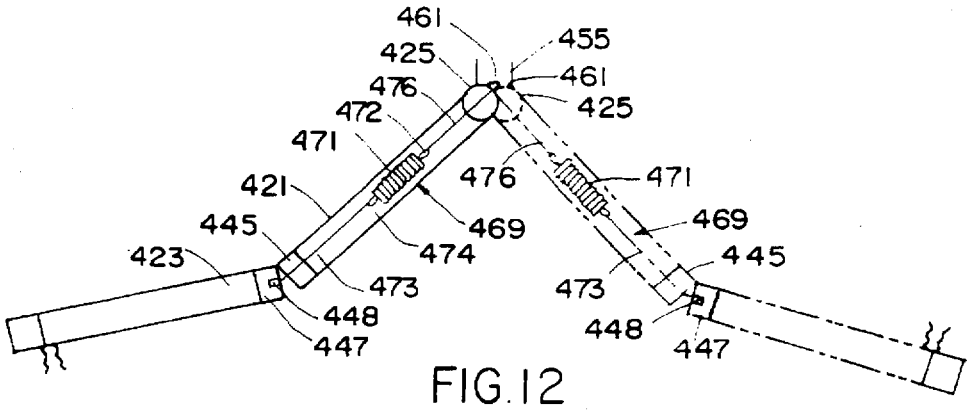
FIG. 12 is a cross-sectional side view of the embodiment of FIG. 11 showing the flexure of the two sub-panels in opposite directions.

Still another embodiment of the present invention is shown in FIGS. 11 and 12, without the side tracks or channels. A releasable panel 419 is shown including an upper sub-panel 421 and a lower sub-panel 423. The lower sub-panel is constructed identically to the lower sub-panel 23 of the FIG. 1 embodiment and includes the same type of retainer members 401. Although the embodiment of FIG. 11 is shown as a high lift or full vertical lift door, as in FIG. 1, this embodiment can also be utilized in a standard lift door, as in FIG. 7, whereby the retainer member and interconnection of the side frame members 481, 483 will be the same as the FIG. 7 embodiment. That is, the bottom sub-panel 423 may be the same as the bottom sub-panel 223 and include the same interconnections as shown in FIG. 9.

A plurality of U-shaped brackets 455 are bolted to the adjacent bottom most nonreleasable panel 407. Alternatively, a single elongated bracket may be bolted to the panel 407, which bracket extends substantially across the entire side-to-side width of the panel 407. The brackets 455 have a bottom web portion 461 with an opening or hole therethrough.

Abutting the bottom web portion 461 of the brackets 455 is the rigid top horizontal member, comprising a cylindrical swivel tube 425 of similar construction to the tube 25 of FIG. 1. Unlike FIG. 1, there are no swivel sleeves within the tube, except for the two cylindrical swivel sleeves 489 affixed to the side frame members 481, 483 in a manner similar to the FIG. 1 embodiment. Holes or openings are provided through the tube 425, aligned with the hole or opening through the webs 461 of the brackets 455 to receive an end of the spring members 469, as will be described.

Spring members 469 are disposed within the interior region of the upper sub-panel 421. The spring members include a coil spring 471 having circular or hook-like eyelets 472, 474 at opposite ends for connecting with non-stretchable wires 473, 476, which have loops at their ends that hook over, or are tied to, the eyelets. Non-stretchable wire 473 extends through openings in intermediate members 445, 447 to be retained to member 447, such as by an expanded button or cylinder piece 448 having a diameter greater than that of the opening within the horizontal member 447. Non-stretchable wire 476 extends through the holes or openings of the tube 425 and bracket web 461 to be tied or otherwise be retained to the bracket 455.

The spring force of the coil spring 471 is sufficiently high to maintain the intermediate horizontal member 447 of the bottom sub-panel 423 biased tightly against the intermediate horizontal member 445 of the top sub-panel 421 which, in turn, presses or biases the horizontal top member 425 against the bracket web 461. When an impact force of sufficient magnitude to release the retainer member 401 is received on the panel 419, thus causing displacement and rotation of the releasable panel 419 in directions as best shown in FIG. 12, the tubular member 425 rolls against the web 461 in inward and/or outward directions depending upon the direction of the impact force. The rolling displacement is shown in FIG. 12.

Figure 13:
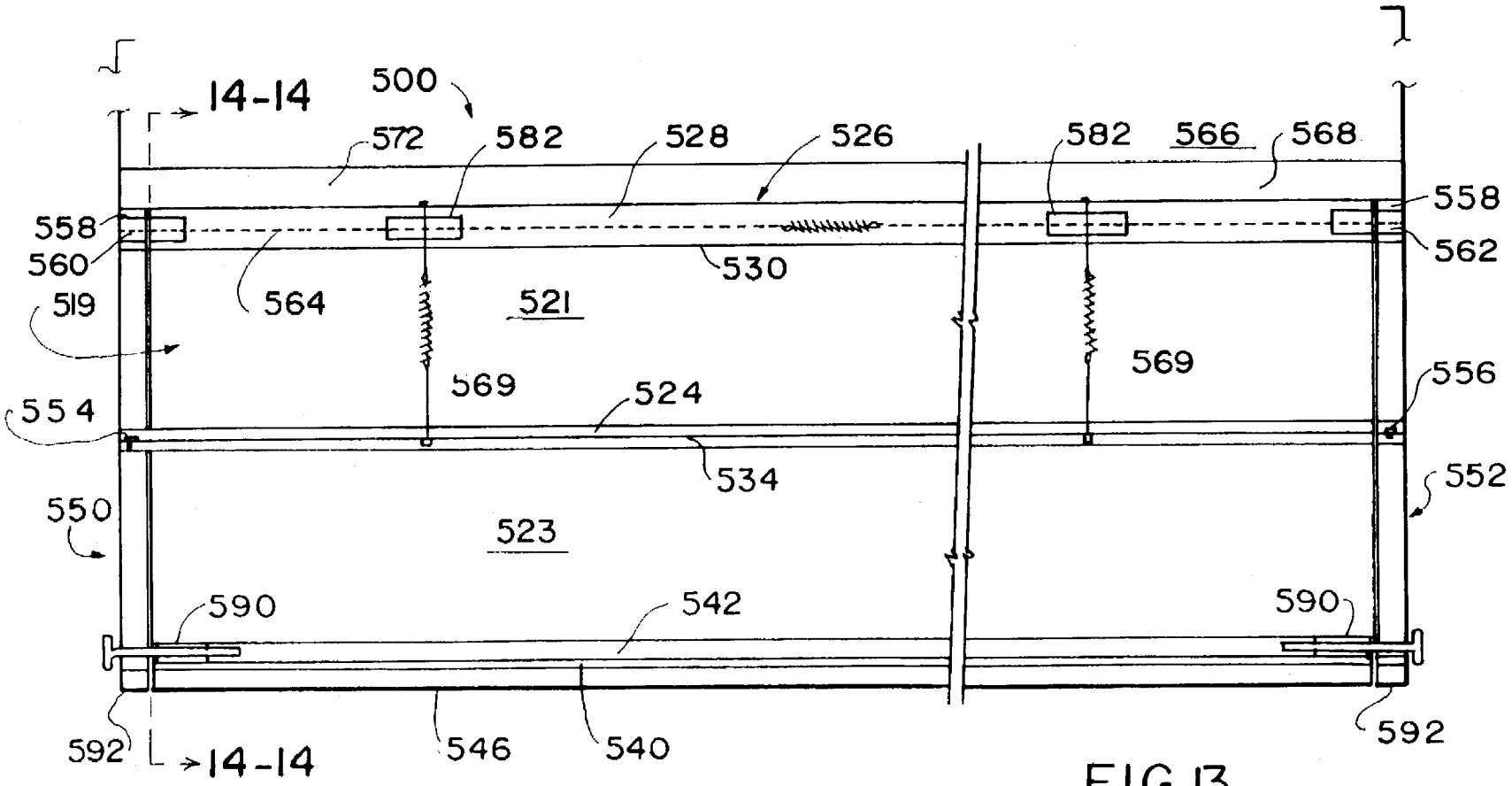
FIG. 13 is a partial cut-away front view of yet another embodiment of a high lift/full vertical lift overhead door from inside the building structure without side tracks or channels.
Figure 14:
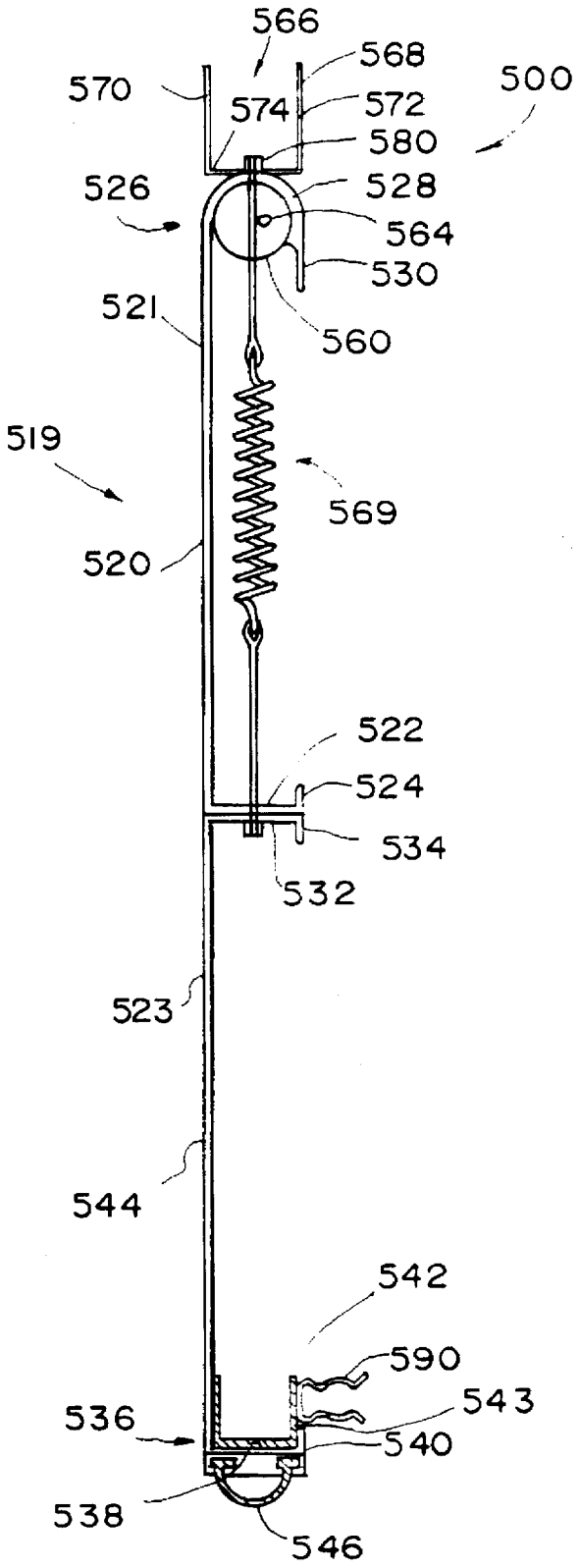
FIG. 14 is a view along section line 14—14 of FIG. 13.
Figure 15:
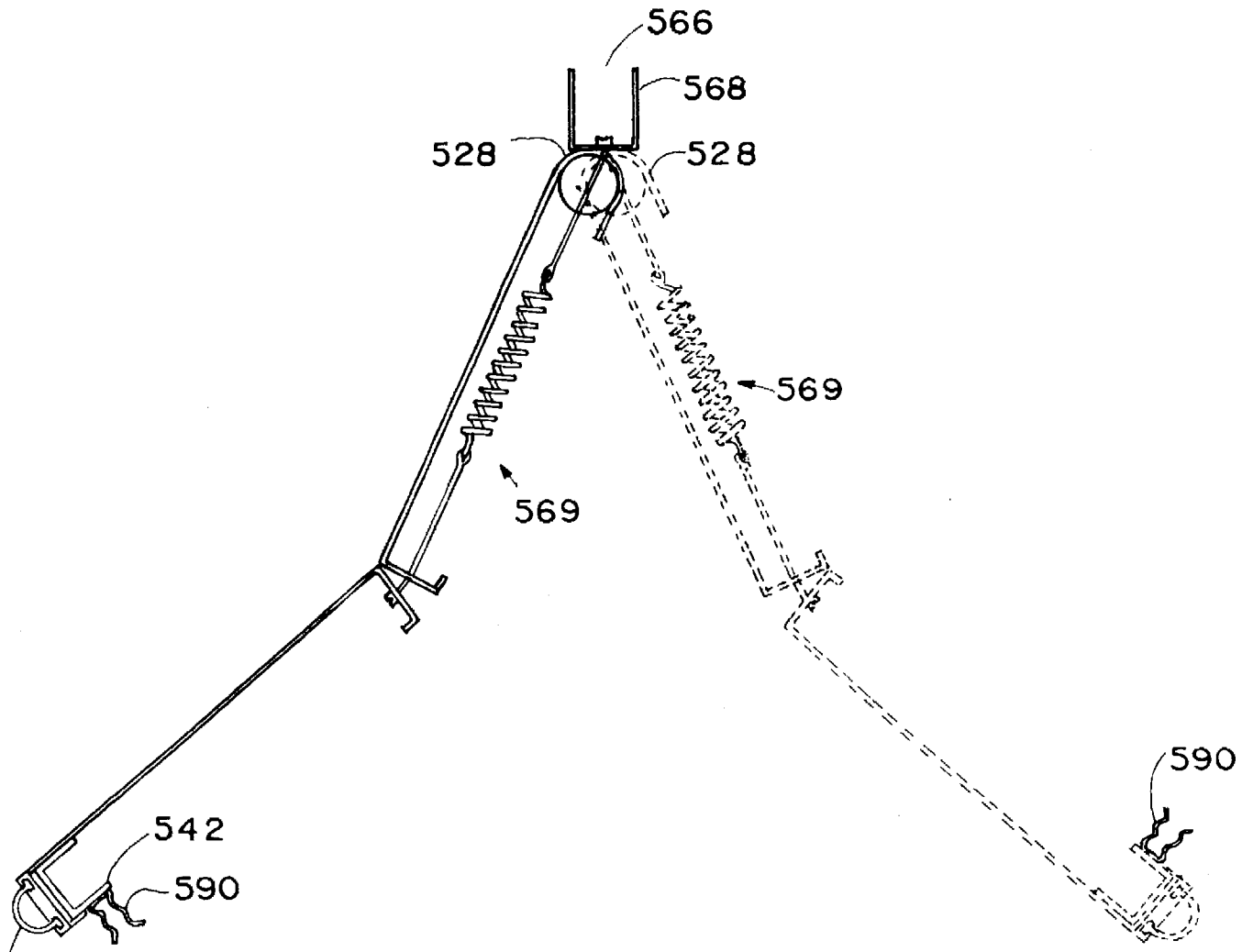
FIG. 15 is a cross-sectional view of the embodiment of FIGS. 13 and 14 showing the flexure of the sub-panels in opposite directions when the panels are struck and released.
Figure 16:
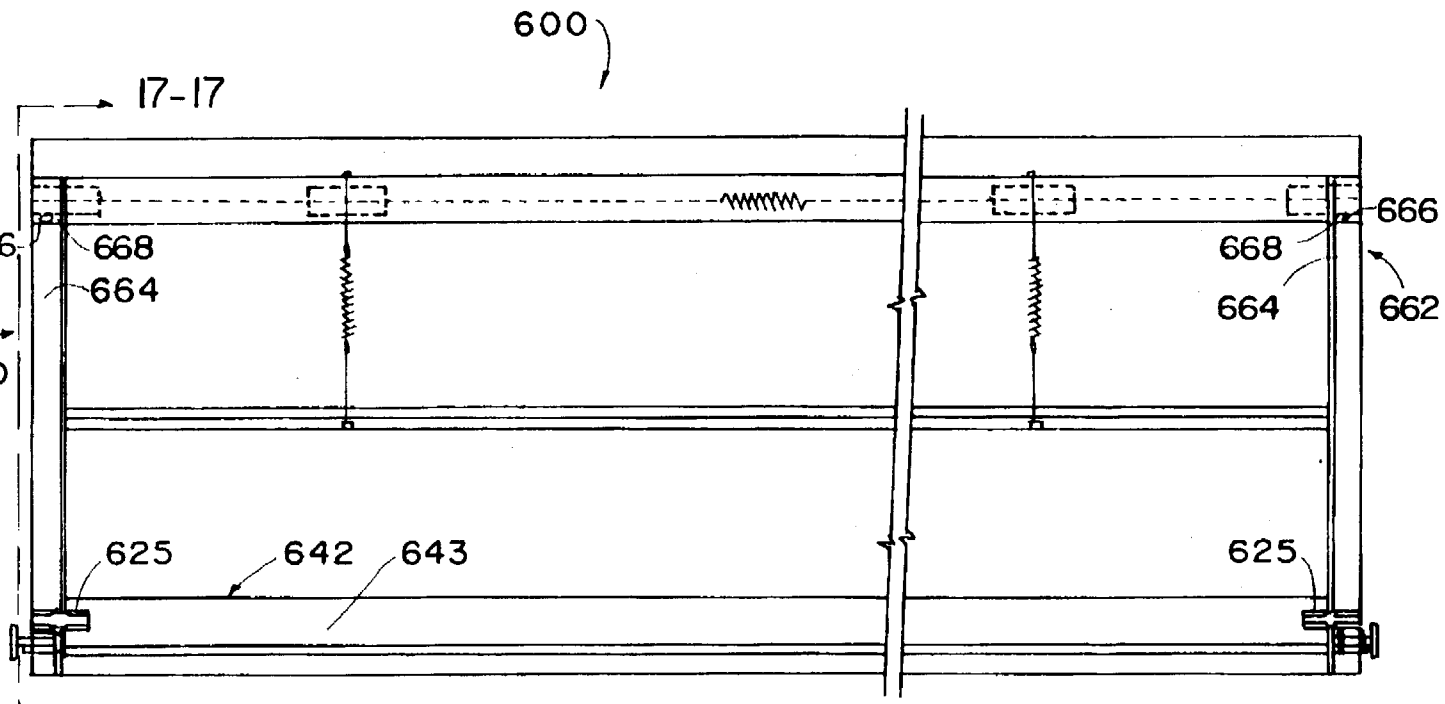
FIG. 16 is a partial cut-away front view of another embodiment of a standard lift overhead door.
Figure 17:
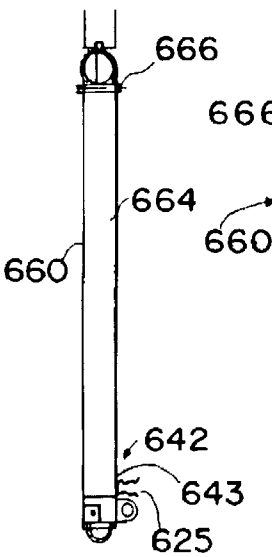
FIG. 17 is a view along section line 17—17 of FIG. 16.

Further embodiments of the invention are shown in FIGS. 13–17, but without the side tracks or channels, and without fully depicting the non-releasable panels. FIGS. 13–15 show a releasable panel arrangement 500 for high lift or full vertical lift systems; FIGS. 16 and 17 show a similar arrangement but in the standard lift type of door system 600. These embodiments are somewhat similar to the embodiment of FIGS. 11 and 12.

In FIGS. 13–15, a releasable panel 519 is shown including an upper sub-panel 521 and a lower sub-panel 523. The upper and lower sub-panels are preferably formed from a rigid fiberglass material or a rigid plastics material. The upper sub-panel 521 has a front face 520, a bottom intermediate web portion 522 and an upstanding vertically disposed lip portion 524 parallel to the front face 520. The top part 526 of the upper sub-panel 521 is curved to have a semi circular or cylindrical profile 528 with a downwardly extending lip 530 that is parallel to the front face 520. The curved circular or cylindrical region 528 extends more than 180° around so as to capture swivel tubes that are retained therein in a manner to be described.

The lower sub-panel 523 is similarly formed from the same materials and includes an upper intermediate web portion 532 and a downwardly extending lip 534. The bottom portion 536 of the lower sub-panel 523 includes a web portion 538 and an upwardly extending lip 540 to receive a steel channel or square tube 542 that extends along the entire bottom width of the panel from side-to-side. The channel 542 may be affixed to the web 538 and/or to the front face 544 of the lower sub-panel 523 by bolts, not shown. Disposed to the bottom web 538 is a rubber or flexible weather stripping bumper 546.

Side frame members 550, 552 are shown. These are preferably formed from the same material as the panels 521, 523 and have the same profile in side view. However, the side frames are not intended to flex in the center as are the two sub-panels 521, 523 but instead are bolted by bolt and nut assemblies 554, 556 or otherwise fixed together to define a single unitary piece. Thus, these side frame members, or filler tubes, perform similarly as in the above-described embodiments. Captured within the circular or cylindrical regions 558 of each of the side frame members 550, 552 are cylindrical swivel tubes 560, 562 preferably made of steel. These side frame swivel tubes 560, 562 engage with, and are captured by or within the circular or cylindrical top portions 528 of the upper sub-panel 521. Extending widthwise from side-to-side is a spring member 564 which is retained within the tubular cylindrical swivel tubes 560, 562 in a manner similar to that described with respect to the embodiments of FIGS. 1–9 and 10B. This spring arrangement 564 biases the side frame members with respect to the upper sub-panel.

The upper sub-panel is connected to the non-releasable panel 566 by means of a bracket 568 that extends the full side-to-side width across the non-releasable panel 566. The bracket includes front 570 and back 572 faces and a web section 574 therebetween. The bracket 568 is preferably bolted to the non-releasable panel 566, in a manner not shown.

Fixed to the bracket 568 are spring members 569 similar to those shown in FIGS. 11 and 12 each of which extends through the cylindrical portion 528 and through the bottom web 522 of the upper sub-panel 521 and secured to the underside of the upper web 532 of the lower side panel 523. The top ends 580 of the spring members 569 are connected with the web 574 of the bracket. This allows rollable movement of the top portion 528 of the upper sub-panel with respect to the underside of the non-releasable panel, i.e. the underside or web 574 of the bracket 568. Swivel tubes 582, preferably of steel, may be included for additional structural rigidity, in which case the swivel tubes 582 will include holes or openings to allow the extensions of the spring members 569 to pass therethrough. The swivel tubes are captured within the circular upper region 528 in a manner similar to the side frame swivel tubes 558.

The retainer arrangement for the embodiment of FIGS. 13–15 is identical to that shown in the earlier described embodiments for the high lift or full vertical lift doors. (See FIGS. 1–6, 10B, and 11.) The retainer clips are secured to the bottommost steel channel or tube 542, preferably by bolts, not shown.

Weather stripping 592, similar to the weather stripping bumpers 546, is also provided on each of the side frame members 550. Weather stripping (not shown) may fill the space between the side frame members and the releasable panels 521, 523. Weather stripping in this location may also be provided on the above-described embodiments.

The breaking away of the releasable panels is shown in FIG. 15. As is apparent, the upper curved circular or cylindrical portion 528 rolls with respect to the underside or web 574 of the bracket 568 to allow freely swinging and rollable movement therewith in directions into and away from the plane of the door opening.

Although the inside face of the panels 521, 523 are shown open, it should be understood that a facing or covering could be provided with sheeting, such as flexible fabric, particularly PVC. Disposed between the front face and the sheeting is preferably a filler material such as urethane or other foam material. The front faces of the panels could also be covered with PVC or other flexible fabric sheeting.

Additional structural steel supports could be included at locations within the upper and lower sub-panels 521, 523. Alternatively, the entire front faces of the panels 521, 523 need not be fully formed from fiberglass or plastic but may include openings which are covered with flexible material such as flexible fabric. It is important, however, that the peripheral regions, particularly the bottommost horizontal member 542 be structurally rigid to prevent any bending or flexure around or about a vertical axis perpendicular to the bottom horizontal member.

FIGS. 16 and 17 are similar to the embodiment of FIGS. 13–15 but in a standard lift door arrangement. In this embodiment, the side frames have to be more rugged because the counterbalance assembly cable (not shown) for raising and lowering the door is connected to the side frame members 660, 662. Thus, side frame members 660, 662 preferably include square steel tubes 664 similar to the embodiments of FIGS. 1–9 and 10A. The side frame members 660, 662 include rigid fiberglass or plastic portions having a profile identical to the upper and lower sub-panels. The steel tubes or channels are bolted to the fiberglass portions. For example, bolts 666 extend from the front face through a lip region 668 similar to numeral 530 in the FIG. 14 embodiment of the panel to retain the tube 664 to the front face of the side frame member 660.

The retainer members of FIGS. 16 and 17 are identical to that of the standard lift assembly embodiments shown in FIGS. 7–9 and 10A. The retainer clip 625 fixed to the lower sub-panel is preferably bolted to the upstanding steel face 643 of the channel 642. The face 643 is higher than the face 543 of the embodiment shown in FIG. 14. That is, the upstanding face 643 extends further toward the top of the lower sub-panel in order to provide sufficient space for fixing the retainer clip 625.

Other than the distinctions discussed above, the embodiment of FIGS. 16 and 17 is substantially identical to the embodiment of FIGS. 13–15 and will release and be freely swingable in a manner similar to that shown in FIG. 15.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention as defined by the claims.

I claim:

1. A vertically-movable overhead door comprising a plurality of hingedly connected non-releasable rectangular panels having rollers extending from side edges of the panels and guided within channels having a vertical portion mounted adjacent side edges of a door opening, said overhead door further comprising a releasable panel pivotally connected to the bottommost non-releasable rectangular panel, said releasable panel having a rectangular frame defined by rigid top and bottom horizontal members and a pair of side structures, each side structure formed from at least one rigid side beam, said rigid top member pivotally connected with the bottommost non-releasable rectangular panel for enabling pivotal and freely swingable movement of said releasable panel with respect to said non-releasable panel in directions into and away from the plane of the door opening, roller means within said channels for guiding movement of said releasable panel, and a retainer member fixedly connected to said rectangular frame adjacent said rigid side beam, said retainer member retaining said releasable panel with respect to said channels during upward and downward movement of said releasable panel and for releasing said releasable panel to enable freely swingable movement of said releasable panel with respect to said vertical channels when a predetermined impact force is applied to said releasable panel.

2. The overhead door of claim 1 wherein each of said rigid top and bottom horizontal members remains free of flexure in the direction of an impact force applied thereto.

3. The overhead door of claim 2 further comprising a pair of side frame members, each side frame member positioned adjacent opposite side structures of said rectangular frame and pivotally connected with said horizontal rigid top member of said rectangular frame, wherein said releasable panel is pivotable and swingable in directions into and away from the plane of the door opening with respect to said side frame members.

4. The overhead door of claim 3 wherein the side-to-side combined width of said non-releasable panels and said channels is greater than the side-to-side width of the door opening and the side-to-side width of said releasable panel is less than the side-to-side width of the door opening, and wherein the combined side-to-side width of said releasable panel and said pair of side frame members is substantially the same as the side-to-side width of said non-releasable panels.

5. The overhead door of claim 3 wherein said roller means is connected with each of said side frame members adjacent bottom edges of said side frame members.

6. The overhead door of claim 5 wherein said roller means includes a roller positioned within said vertical channel and a roller shaft journaled to said roller, said roller shaft retained to said side frame member.

7. The overhead door of claim 3 wherein said roller means is connected with said releasable panel.

8. A vertically-movable overhead door comprising a plurality of hingedly connected non-releasable rectangular panels having rollers extending from side edges of the panels and guided within channels having a vertical portion mounted adjacent side edges of a door opening, said overhead door further comprising a releasable panel pivotally connected to the bottommost non-releasable rectangular panel, said releasable panel having a rectangular frame defined by rigid top and bottom horizontal members and a pair of side structures, each side structure formed from at least one rigid side beam, said rigid top member pivotally connected with the bottommost non-releasable rectangular panel for enabling pivotal and freely swingable movement of said releasable panel with respect to said non-releasable panel in directions into and away from the plane of the door opening, a pair of side frame members, each side frame member positioned adjacent opposite side structures of said rectangular frame and pivotally connected with said horizontal rigid top member of said rectangular frame, roller means within said channels for guiding movement of said releasable panel, said roller means connected with each of said side frame members adjacent bottom edges of said side frame members and a retainer member fixedly connected to said rectangular frame adjacent said rigid side beam, said retainer member retaining said releasable panel with respect to said channels during upward and downward movement of said releasable panel and for releasing said releasable panel to enable freely swingable movement of said releasable panel with respect to said vertical channels when a predetermined impact force is applied to said releasable panel, wherein said retainer member comprises a retaining clip fixedly connected with said rigid side beam of said releasable panel, said retaining clip releasably capturing a cylindrical retaining shaft at one end region of said retaining shaft, said retaining shaft oriented substantially parallel to said top and bottom horizontal members of said releasable panel, and wherein said adjacent side frame member includes a side frame retaining clip releasably capturing said retaining shaft at an opposite end region thereof, wherein said retaining clip disconnects from said cylindrical retaining shaft upon receipt of an impact force on the releasable panel to enable said releasable panel to freely swing in directions into and away from the plane of the door opening without flexure of the releasable panel about a vertical axis and without lateral movement of said rigid side beams of said rectangular frame, wherein said releasable panel is pivotable and swingable in directions into and away from the plane of the door opening with respect to said side frame members, and wherein each of said rigid top and bottom horizontal members remains free of flexure in the direction of an impact force applied thereto.

9. The overhead door of claim 8 wherein said retaining clip includes a pair of retaining clip arms in facing relationship to each other and having a profile to accommodate said cylindrical retaining shaft, said retaining clip arms being flexible and biased to secure said retaining shaft and being spreadable to release from said cylindrical shaft upon receipt of a predetermined impact force on said releasable panel.

10. A vertically-movable overhead door comprising a plurality of hingedly connected non-releasable rectangular panels having rollers extending from side edges of the panels and guided within channels having a vertical portion mounted adjacent side edges of a door opening, said overhead door further comprising a releasable panel pivotally connected to the bottommost non-releasable rectangular panel, said releasable panel having a rectangular frame defined by rigid top and bottom horizontal members and a pair of side structures, each side structure formed from at least one rigid side beam, said rigid top member pivotally connected with the bottommost non-releasable rectangular panel for enabling pivotal and freely swingable movement of said releasable panel with respect to said non-releasable panel in directions into and away from the plane of the door opening, wherein the pivotal connection of said rigid top horizontal member with the bottommost non-releasable rectangular panel comprises a plurality of bolt shafts extending from a bottom edge of said non-releasable panel into said rigid top horizontal member, each said bolt shaft connected with a cylindrical swivel sleeve, said rigid top horizontal member comprising a cylindrical swivel tube extending along the side-to-side width of said releasable panel, said swivel tube surrounding each of said swivel sleeves and including a circumferentially oriented slot through which said bolt shaft passes therethrough to enable free rotational movement of said swivel tube about said swivel sleeves, roller means within said channels for guiding movement of said releasable panel, and a retainer member fixedly connected to said rectangular frame adjacent said rigid side beam, said retainer member retaining said releasable panel with respect to said channels during upward and downward movement of said releasable panel and for releasing said releasable panel to enable freely swingable movement of said releasable panel with respect to said vertical channels when a predetermined impact force is applied to said releasable panel, wherein each of said rigid top and bottom horizontal members remains free of flexure in the direction of an impact force applied thereto.

11. A vertically-movable overhead door comprising a plurality of hingedly connected non-releasable rectangular panels having rollers extending from side edges of the panels and guided within channels having a vertical portion mounted adjacent side edges of a door opening, said overhead door further comprising a releasable panel pivotally connected to the bottommost non-releasable rectangular panel, said releasable panel having a rectangular frame defined by rigid top and bottom horizontal members and a pair of side structures, each side structure formed from at least one rigid side beam, said rigid top member pivotally connected with the bottommost non-releasable rectangular panel for enabling pivotal and freely swingable movement of said releasable panel with respect to said non-releasable panel in directions into and away from the plane of the door opening, roller means within said channels for guiding movement of said releasable panel, and a retainer member fixedly connected to said rectangular frame adjacent said rigid side beam, said retainer member retaining said releasable panel with respect to said channels during upward and downward movement of said releasable panel and for releasing said releasable panel to enable freely swingable movement of said releasable panel with respect to said vertical channels when a predetermined impact force is applied to said releasable panel wherein said releasable panel is bifurcated to comprise first and second rectangular sub-panels pivotal with respect to each other along a substantially horizontal axis by spring biasing means for enabling flexure and return of said first and second rectangular sub-panels between aligned coplanar positions and angularly disposed positions, and wherein each of said rigid top and bottom horizontal members remains free of flexure in the direction of an impact force applied thereto.

12. The overhead door of claim 11 wherein each of said pair of side structures includes two rigid side beams and wherein said releasable panel includes first and second horizontally-disposed rigid intermediate frame members, said first rectangular sub-panel defined by said top horizontal member, said first horizontal intermediate member, and two rigid side beams, and said second rectangular sub-panel defined by said bottom horizontal member, said second horizontal intermediate member, and two-rigid side beams, said spring biasing means biasing said second horizontal intermediate member with respect to said first horizontal intermediate member.

13. A vertically-movable overhead door comprising a plurality of hingedly connected non-releasable rectangular panels having rollers extending from side edges of the panels and guided within channels having a vertical portion mounted adjacent side edges of a door opening, said overhead door further comprising a releasable panel pivotally connected to the bottommost non-releasable rectangular panel, said releasable panel having a rectangular frame defined by rigid top and bottom horizontal members and a pair of side structures, each side structure formed from at least one rigid side beam, said rigid top member pivotally connected with the bottommost non-releasable rectangular panel for enabling pivotal and freely swingable movement of said releasable panel with respect to said non-releasable panel in directions into and away from the plane of the door opening, a pair of side frame members, each side frame member positioned adjacent opposite side structures of said rectangular frame and pivotally connected with said horizontal rigid top member of said rectangular frame, roller means within said channels for guiding movement of said releasable panel, said roller means connected with said releasable panel, and a retainer member fixedly connected to said rectangular frame adjacent said rigid side beam, said retainer member retaining said releasable panel with respect to said channels during upward and downward movement of said releasable panel and for releasing said releasable panel to enable freely swingable movement of said releasable panel with respect to said vertical channels when a predetermined impact force is applied to said releasable panel, wherein said roller means includes a roller positioned within said channel and a roller shaft journaled to said roller, said roller shaft releasably connected with said retainer member, wherein said releasable panel is pivotable and swingable in directions into and away from the plane of the door opening with respect to said side frame members, and wherein each of said rigid top and bottom horizontal members remains free of flexure in the direction of an impact force applied thereto.

14. The overhead door of claim 13 wherein said retainer member includes a retaining clip fixedly connected to said rectangular frame, said retaining clip releasably capturing a cylindrical retaining tube oriented substantially parallel to said top and bottom horizontal members, said roller shaft insertable within said retaining tube, wherein said retaining clip disconnects from said cylindrical retaining tube upon receipt of an impact force on the releasable panel to enable said releasable panel to freely swing in directions into and away from the plane of the door opening without flexure or bending of the releasable panel about an axis perpendicular to said bottom horizontal member and without lateral movement of said side structures of said rectangular frame.

15. The overhead door of claim 14 wherein said retaining clip includes a pair of retaining clip arms in facing relationship to each other and having a profile to accommodate said cylindrical retaining tube, said retaining clip arms being flexible and biased to secure said retaining tube and being spreadable to release from said cylindrical tube upon receipt of a predetermined impact force on said releasable panel.

16. In an overhead door having a plurality of hingedly connected non-releasable rectangular panels guided for movement within channels having a vertical portion mounted adjacent side edges of a door opening so as to open and close the door opening and including a breakaway panel hingedly connected to the bottommost non-releasable panel, the improvement comprising, said breakaway panel comprising, a first sub-panel defined by a rectangular frame formed from a top horizontal member, a bottom horizontal member, and parallel side members, said first sub-panel further comprising front and back faces of sheeting, said rigid top horizontal member pivotally connected with said bottommost non-releasable panel to enable freely swingable movement of said first sub-panel with respect to said non-releasable panel; a second sub-panel defined by a rectangular frame formed from a top horizontal member, a bottom horizontal member, and parallel side members, said second sub-panel further comprising front and back faces of sheeting, said rectangular frame of said second sub-panel including retaining means for releasably maintaining said second sub-panel in a retained position with respect to said channels as said overhead door is moved to open and close the door opening and for releasing said second panel from the retained position upon receipt of a releasably-sufficient impact force upon said breakaway panel; spring bias means for connecting said first sub-panel with said second sub-panel so that said first and second sub-panels lie in a common plane, when the door opening is closed, with said bottom horizontal member of said first sub-panel and said top horizontal member of said second sub-panel biased in abutting relationship with each other, and for enabling said second sub-panel to flex and separate against the spring bias force of said spring bias means to enable said first and second sub-panels to be flexed and angled with respect to each other out of coplanarity upon receipt of a releasably-sufficient impact force upon said breakaway panel.

17. The overhead door of claim 16 wherein said spring bias means comprises a pair of elongated spring members having a resilient portion, each spring member having first and second ends, the first ends of each spring member connected with the rectangular frame of said first sub-panel in the interior space thereof defined between said front and back faces and having the second end extending through said bottom horizontal member of said first sub-panel and connected with said top horizontal member of said second sub-panel.

18. The overhead door of claim 17 wherein the space defined by the rectangular frame and front and back faces of each of said first second sub-panels is substantially filled with resilient foam material.

19. The overhead door of claim 16 wherein the rectangular frame of said second sub-panel is rigid and remains free of flexure or deformation in the direction of an impact force applied thereto.

20. The overhead door of claim 16 wherein the rectangular frames of each of said first and second sub-panels are rigid and incapable of flexure or deformation in the direction of an impact force applied thereto.

21. In an overhead door having at least one non-releasable rectangular panel guided for movement within channels having a vertical portion mounted adjacent side edges of a door opening so as to open and close the door opening and a breakaway panel adjacent to said non-releasable panel, the improvement comprising, said breakaway panel comprising, a first sub-panel defined by a rectangular frame formed from a top horizontal member, a bottom horizontal member, and parallel side members, said first sub-panel further comprising front and back faces, said rigid top horizontal member abutting said bottommost non-releasable panel to enable freely swingable movement of said first sub-panel with respect to said non-releasable panel; a second sub-panel defined by a rectangular frame formed from a top horizontal member, a bottom horizontal member, and parallel side members, said second sub-panel further comprising front and back faces, said rectangular frame of said second sub-panel including retaining means for releasably maintaining said second sub-panel in a retained position with respect to said channels as said overhead door is moved to open and close the door opening and for releasing said second panel from the retained position upon receipt of a releasably-sufficient impact force upon said breakaway panel; spring bias means for connecting said non-releasable panel with said second sub-panel so that said non-releasable panel and said first and second sub-panels He in a common plane when the door opening is closed, with said bottom horizontal member of said first sub-panel and said top horizontal member of said second sub-panel biased in abutting relationship with each other, and for enabling said second sub-panel to flex and separate against the spring bias force of said spring bias means to enable said first and second sub-panels to be flexed and angled with respect to each other out of coplanarity upon receipt of a releasably-sufficient impact force upon said breakaway panel.

22. The overhead door of claim 21 wherein said spring bias means comprises a plurality of elongated spring members having a resilient portion, each spring member having first and second ends, the first ends of each spring member connected with said non-releasable panel and having the second end extending through said bottom horizontal member of said first sub-panel and connected with said top horizontal member of said second sub-panel.

23. The overhead door of claim 22 wherein said non-releasable panel includes a plurality of brackets having face portions facing said top horizontal member, wherein said first ends of each spring member are connected with said bracket face portions.

24. The overhead door of claim 23 wherein said top horizontal member comprises a tubular member and abuts the face portions of the plurality of brackets, and is rollable with respect to the face portions.

25. The overhead door of claim 21 wherein the rectangular frame of said second sub-panel is rigid and remains free of flexure or deformation in the direction of an impact force applied thereto.

26. The overhead door of claim 21 wherein the rectangular frames of each of said first and second sub-panels are substantially rigid and incapable of significant flexure or deformation in the direction of an impact force applied thereto.

27. A vertically-movable sectional overhead door comprising at least one non-releasable rectangular panel having guide elements extending from side edges of the panel and guided within channels having a vertical portion mountable adjacent side edges of a door opening, said overhead door further comprising at least one releasable panel disposed adjacent said non-releasable rectangular panel, said releasable panel having a rectangular shape including rigid top and bottom horizontal portions, said rigid top portion rotatable with respect to said adjacent non-releasable rectangular panel for enabling freely swingable movement of said releasable panel with respect to said non-releasable panel in directions into and away from the plane of the door opening, guide structures within said channels for guiding movement of said releasable panel, a retainer fixedly connected to said releasable panel and a retaining member detachably coupled to said retainer for retaining said releasable panel with respect to said channels during upward and downward movement of said releasable panel and for releasing said releasable panel to enable freely swingable movement of said releasable panel with respect to said vertical channels when a predetermined impact force is applied to said releasable panel, said releasing resulting from detachment and separation of said retaining member from said retainer.

28. The overhead door of claim 27 wherein said guide structures comprise rollers.

29. A vertically-movable sectional overhead door comprising at least one non-releasable rectangular panel having guide elements extending from side edges of the panel and guided within channels having a vertical portion mountable adjacent side edges of a door opening, said overhead door further comprising at least one releasable panel disposed adjacent said non-releasable rectangular panel, said releasable panel having a rectangular shape including rigid top and bottom horizontal portions, said rigid top portion rotatable with respect to said adjacent non-releasable rectangular panel for enabling freely swingable movement of said releasable panel with respect to said non-releasable panel in directions into and away from the plane of the door opening, guide structures comprising rollers within said channels for guiding movement of said releasable panel, a retainer fixedly connected to said releasable panel and a retaining member detachably coupled to said retainer for retaining said releasable panel with respect to said channels during upward and downward movement of said releasable panel and for releasing said releasable panel to enable freely swingable movement of said releasable panel with respect to said vertical channels when a predetermined impact force is applied to said releasable panel, said releasing resulting from detachment of said retaining member from said retainer wherein said retaining member comprises a shaft of at least one of said rollers.

30. The overhead door of claim 29 wherein said retainer comprises a retaining clip for detachably capturing said roller shaft.

31. A vertically-movable sectional overhead door comprising at least one non-releasable rectangular panel having guide elements extending from side edges of the panel and guided within channels having a vertical portion mountable adjacent side edges of a door opening, said overhead door further comprising at least one releasable panel disposed adjacent said non-releasable rectangular panel, said releasable panel having a rectangular shape including rigid top and bottom horizontal portions, said rigid top portion rotatable with respect to said adjacent non-releasable rectangular panel for enabling freely swingable movement of said releasable panel with respect to said non-releasable panel in directions into and away from the plane of the door opening, guide structures comprising rollers within said channels for guiding movement of said releasable panel, a retainer fixedly connected to said releasable panel and a retaining member detachably coupled to said retainer for retaining said releasable panel with respect to said channels during upward and downward movement of said releasable panel and for releasing said releasable panel to enable freely swingable movement of said releasable panel with respect to said vertical channels when a predetermined impact force is applied to said releasable panel, said releasing resulting from detachment of said retaining member from said retainer, wherein said rollers include a roller shaft and wherein said retaining member comprises a separate shaft distinct from said roller shaft.

32. A vertically-movable sectional overhead door comprising at least one non-releasable rectangular panel having guide elements extending from side edges of the panel and guided within channels having a vertical portion mountable adjacent side edges of a door opening, said overhead door further comprising at least one releasable panel disposed adjacent said non-releasable rectangular panel, said releasable panel having a rectangular shape including rigid top and bottom horizontal portions, said rigid top portion rotatable with respect to said adjacent non-releasable rectangular panel for enabling freely swingable movement of said releasable panel with respect to said non-releasable panel in directions into and away from the plane of the door opening, guide structures within said channels for guiding movement of said releasable panel, a retainer fixedly connected to said releasable panel and a retaining member detachably coupled to said retainer for retaining said releasable panel with respect to said channels during upward and downward movement of said releasable panel and for releasing said releasable panel to enable freely swingable movement of said releasable panel with respect to said vertical channels when a predetermined impact force is applied to said releasable panel, said releasing resulting from detachment of said retaining member from said retainer, wherein said releasable panel includes an upper rectangular sub-panel and a lower rectangular sub-panel, said upper sub-panel including a curved upper edge in abutting relationship to an adjacent non-releasable panel, spring bias means for connecting said lower sub-panel to said non-releasable panel, said spring bias means including a spring having one end connected to said non-releasable panel, said spring extending through the upper sub-panel, and having its other end connected to said lower sub-panel, whereby the upper sub-panel is biased in abutting relationship to said non-releasable panel.

33. The overhead door of claim 32 wherein said adjacent non-releasable panel includes a bracket member facing said upper sub-panel, wherein said curved upper edge of said upper sub-panel abuts said bracket member.

34. In an overhead door having at least one non-releasable rectangular panel guided for movement within channels having a vertical portion mounted adjacent side edges of a door opening so as to enable opening and closing of the door opening, and a breakaway panel adjacent to said non-releasable panel, the improvement comprising, said breakaway panel comprising, a first rectangular sub-panel including an integrally-formed top horizontal edge member, a bottom horizontal edge member, and parallel side edges, said top horizontal edge member abutting said non-releasable panel to enable freely swingable movement of said first rectangular sub-panel with respect to said non-releasable panel in directions into and away from the plane of the door opening; a second rectangular sub-panel including an integrally formed top horizontal edge member, a bottom horizontal edge member, and parallel side edges, said second rectangular sub-panel including retaining means for releasably maintaining said second sub-panel in a retained position with respect to said channels as said overhead door is moved to open and close the door opening and for releasing said second panel from the retained position upon receipt of a releasably-sufficient impact force upon said breakaway panel; spring bias means inter-connecting said non-releasable panel with said second sub-panel so that said non-releasable panel and said first and second sub-panels lie in a common plane when the door opening is closed, with said bottom horizontal edge member of said first sub-panel and said top horizontal edge member of said second sub-panel biased in abutting relationship with each other, and for enabling said second sub-panel to flex and separate against the spring bias force of said spring bias means to enable said first and second sub-panels to be flexed and angled with respect to each other out of coplanarity upon receipt of a releasably-sufficient impact force upon said breakaway panel.

35. The overhead door of claim 34 wherein said spring bias means comprises a plurality of elongated spring members each having a resilient portion and first and second ends, the first ends of each spring member connected with said non-releasable panel and having the second end extending through said bottom horizontal edge member of said first sub-panel and connected with said top horizontal edge member of said second sub-panel.

36. The overhead door of claim 35 wherein said non-releasable panel includes an elongated bracket having a web portion facing said top horizontal edge member, wherein said first ends of each spring member are connected with said bracket web portion.

37. The overhead door of claim 36 wherein said top horizontal edge member includes a cylindrical edge which abuts the web portion of said elongated bracket, and is rollable with respect to the web portion.

38. The overhead door of claim 34 wherein said second rectangular sub-panel is rigid and remains free of flexure or deformation in the direction of an impact force applied thereto.

39. The overhead door of claim 34 wherein each of said first and second rectangular sub-panels are substantially rigid and incapable of significant flexure or deformation in the direction of an impact force applied thereto.

40. The overhead door of claim 34 wherein said second sub-panel includes a rigid beam mounted to said bottom horizontal edge member of said second sub-panel.

41. The overhead door of claim 40 wherein said retaining means is affixed to said rigid beam.

42. The overhead door of claim 34 wherein said first and second rectangular sub-panels are integrally formed from rigid fiberglass.

43. The overhead door of claim 42 wherein each of said first and second rigid fiberglass sub-panels are incapable of substantial flexure or deformation in the direction of an impact force applied thereto.

44. A vertically-movable sectional overhead door comprising at least one non-releasable rectangular panel having guide elements extending from side edges of the panel and guided within channels having a vertical portion mountable adjacent side edges of a door opening, said overhead door further comprising at least one releasable panel disposed adjacent said non-releasable rectangular panel, said releasable panel having a rectangular shape including rigid top and bottom horizontal portions, said rigid top portion rotatable with respect to said adjacent non-releasable rectangular panel for enabling freely swingable movement of said releasable panel with respect to said non-releasable panel in directions into and away from the plane of the door opening, guide structures within said channels for guiding movement of said releasable panel, a retainer fixedly connected to said releasable panel and a retaining member releasably coupled to said retainer for retaining said releasable panel with respect to said channels during upward and downward movement of said releasable panel and for releasing said releasable panel to enable freely swingable movement of said releasable panel with respect to said vertical channels when a predetermined impact force is applied to said releasable panel, said releasing resulting from release of said retaining member from said retainer, wherein said releasable panel includes an upper rectangular sub-panel and a lower rectangular sub-panel, said upper sub-panel including an upper edge in abutting relationship to an adjacent non-releasable panel, a tensioning member for connecting said lower sub-panel to said non-releasable panel, whereby the upper sub-panel is biased in abutting relationship to said non-releasable panel.

45. The overhead door of claim 44 wherein said non-releasable panel includes a bracket member facing said upper sub-panel, wherein said upper edge of said upper sub-panel abuts said bracket member.

46. The overhead door of claim 45 wherein said tensioning member comprises a spring having one end connected to said bracket member of said non-releasable panel and its other end connected to said lower sub-panel.

47. In an overhead door having at least one non-releasable rectangular panel guided for movement within channels having a vertical portion mounted adjacent side edges of a door opening so as to enable opening and closing of the door opening, and a breakaway panel adjacent to said non-releasable panel, the improvement comprising, said breakaway panel comprising, a first rectangular sub-panel including an integrally-formed top horizontal edge member, a bottom horizontal edge member, and parallel side edges, said top horizontal edge member abutting said non-releasable panel to enable freely swingable movement of said first rectangular sub-panel with respect to said non-releasable panel in directions into and away from the plane of the door opening; a second rectangular sub-panel including an integrally formed top horizontal edge member, a bottom horizontal edge member, and parallel side edges, said second rectangular sub-panel including a retaining structure for releasably maintaining said second sub-panel in a retained position with respect to said channels as said overhead door is moved to open and close the door opening and for releasing said second panel from the retained position upon receipt of a releasably-sufficient impact force upon said breakaway panel; a tensioning member inter-connecting said non-releasable panel with said second sub-panel so that said non-releasable panel and said first and second sub-panels lie in a common plane when the door opening is closed, with said bottom horizontal edge member of said first sub-panel and said top horizontal edge member of said second sub-panel biased in abutting relationship with each other, and for enabling said second sub-panel to flex and separate against the tensioning force of said tensioning member to enable said first and second sub-panels to be flexed and angled with respect to each other out of coplanarity upon receipt of a releasably-sufficient impact force upon said breakaway panel.

48. The overhead door of claim 47 wherein said tensioning member comprises an elongated spring having a resilient portion and first and second ends, the first end of said spring connected with said non-releasable panel and having the second end extending through said bottom horizontal edge member of said first sub-panel and connected with said top horizontal edge member of said second sub-panel.

49. The overhead door of claim 47 wherein said non-releasable panel includes an elongated bracket having a web portion facing said top horizontal edge member, and wherein said tensioning member is connected with said bracket web portion.

* * * * *